US007588100B2

(12) United States Patent
Hamilton

(10) Patent No.: US 7,588,100 B2
(45) Date of Patent: Sep. 15, 2009

(54) METHOD AND APPARATUS FOR DIRECTIONAL DRILLING WITH VARIABLE DRILL STRING ROTATION

(75) Inventor: James F Hamilton, Calgary (CA)

(73) Assignee: Precision Drilling Corporation, Calgary, Alberta (CA)

( * ) Notice: Subject to any disclaimer, the term of this patent is extended or adjusted under 35 U.S.C. 154(b) by 85 days.

(21) Appl. No.: 11/851,384

(22) Filed: Sep. 6, 2007

(65) Prior Publication Data

US 2009/0065258 A1 Mar. 12, 2009

(51) Int. Cl.
*E21B 7/04* (2006.01)

(52) U.S. Cl. ..... 175/61; 175/73; 175/74

(58) Field of Classification Search ..... 175/61, 175/73, 74

See application file for complete search history.

(56) References Cited

U.S. PATENT DOCUMENTS 4,577,701 A * 3/1986 Dellinger et al. ..... 175/61
4,667,751 A * 5/1987 Geczy et al. ..... 175/61
4,972,703 A * 11/1990 Ho ..... 73/152.49
5,454,436 A * 10/1995 Jardine et al. ..... 175/40
5,465,799 A * 11/1995 Ho ..... 175/61
5,602,541 A * 2/1997 Comeau et al. ..... 340/853.3
5,738,178 A 4/1998 Williams et al.
5,979,570 A 11/1999 McLoughlin et al.
6,050,348 A 4/2000 Richarson et al.
6,158,529 A 12/2000 Dorel
6,561,289 B2 * 5/2003 Portman et al. ..... 175/104
6,918,453 B2 7/2005 Haci et al.
6,997,271 B2 2/2006 Nichols et al.
7,096,979 B2 8/2006 Haci et al.
7,152,696 B2 12/2006 Jones
7,222,681 B2 * 5/2007 Jones et al. ..... 175/38
2006/0162962 A1 7/2006 Koederitz et al.
2009/0057018 A1 * 3/2009 Farley ..... 175/73

OTHER PUBLICATIONS

Eric Maidla and Marc Haci, Understanding Torque: The Key to Slide-Drilling Directional Wells, IADC/SPE Conference in Dallas, Mar. 2-4, 2004, IADC/SPE 87162.

Eric Maidla, Marc Haci, Scott Jones, Michael Cluchey, Michael Alexander and Tommy Warren, Field Proof of the New Sliding Technology for Directional Drilling, SPE/IADC Drilling Conference in Amsterdam, The Netherlands, Feb. 23-25, 2005, IADC/SPE 92558.

(Continued)

*Primary Examiner*—Jennifer H Gay
*Assistant Examiner*—Blake Michener
(74) *Attorney, Agent, or Firm*—Sean W Goodwin

(57) ABSTRACT

Apparatus and methodology is provided for directional drilling which avoid the effects of static friction between the drill string and the borehole. The drill string is rotated continuously in one direction during rotating drilling and during steering. During steering, the rotary speed of the drill string is varied within a revolution and substantially similarly for each of a plurality of subsequent revolutions. The drill string is rotated very slowly when oriented at or near the desired orientation to achieve the desired change in direction and then rotated much faster during the balance of each revolution. This angular velocity profile results in drilling at or near a desired orientation for a high percentage of the time it takes for each revolution. Changes in an effective tool-face orientation can be effected by shifting the phase of the velocity profile.

17 Claims, 8 Drawing Sheets

OTHER PUBLICATIONS

George Boyadjieff, Dave Murray, Alan Orr, Mike Porche and Peter Thompson, Design Considerations and Field Performance of an Advanced Automatic Driller, SPE/IADC Drilling Conference in Amsterdam, The Netherlands, Feb. 19-21, 2003, SPE/IADC 79827.

* cited by examiner

Steer
20
20
3
14

Fast
ANG VELOCITY (ω)
Minimum
Dynamic
Slow
Steer
23
-90
0
90
180
270
Curve

METHOD AND APPARATUS FOR DIRECTIONAL DRILLING WITH VARIABLE DRILL STRING ROTATION

FIELD OF THE INVENTION

The present invention relates to directional drilling of a borehole and more particularly to method and apparatus for affecting the trajectory of a borehole by continuous rotation of a drill string and varying the rotational speed within each revolution in a manner which is substantially the same for each revolution to effect steering of the borehole.

BACKGROUND OF THE INVENTION

Rotary drilling of a borehole beneath the surface of the earth is a practice typically used as part of an exploitation plan for transporting subsurface fluids, gases and minerals to the earth's surface. A "drill string" extends down the borehole and is suspended from a drilling rig. The drill string creates the borehole. At the distal end of the drill string is the "drill bit" or "bit" which removes material from the circular base of the borehole.

The action of removing this material is usually accomplished by rotating the bit about an axis that is approximately coincident with the center of the borehole. The bit is advanced towards the base of the borehole as material is removed so as to continually remove material and extend the length of the borehole. Such motion to advance the borehole is controlled at the surface by lowering the entire drill string in a controlled manner. The lowering of the drill string may be controlled by monitoring the buoyant weight of the drill string at the surface, the torque required to rotate or hold stationary the drill string, the fluid pressure of the drilling fluid or feedback from downhole telemetry.

When the axis of drill bit rotation is not coincident with the center of the borehole, the hole formed will appear to curve or change direction with respect to the previously drilled borehole. When the orientation of the drill bit rotation is intentionally misaligned with the borehole axis to effect a change in borehole direction it is commonly referred to as "directional drilling".

A common method of drilling directionally uses a drilling fluid driven turbine or "mud motor" to rotate the drill bit. In conventional jointed tubing directional drilling a bottom hole assembly (BHA) comprises, a drilling assembly including the bit, a bent housing and the motor. The BHA is located at the downhole end of a rotary drill string. The bent housing offsets the axis of the drill bit from that of the drill string.

The use of the mud motor allows the drill bit to be rotated independently of the rest of the drill string. The entire drill string may be rotated using rotary power applied at the surface. Typical methods of applying rotational motion to the entire drill string are by the use of a "kelly drive" or "top drive" supported in a drilling rig at surface.

The mud motor drives the drill bit through the bent housing and a universal joint which allows an intentional misalignment with the axis of the borehole. This misalignment may be a set angular displacement from the mud motor axis or it may be adjustable so as to be set to a specific angle either manually at the surface or by remote telemetry when the assembly is in the borehole below the surface.

When the axis of drill bit rotation is misaligned with the axis of the mud motor and the drill string is not being rotated from the surface, the borehole formed will be curved in a manner that depends on the misalignment of these two axes.

Conventional directional drilling is accomplished with an alternating combination of two drilling operations; a period of steering or sliding; and a period of rotating. The result is a borehole with alternating straight and curved sections from the kick off point to the end of the curve. More specifically, during the sliding operation, the drill string is slowly rotated to orient the bent housing in the desired direction and drill string rotation is stopped. The mud motor is then energized so as to drill a curved path in the oriented direction. The non-rotating drill string slides along the borehole as the mud motor/drill bit drill the curved path. The sliding phase is necessary for adjusting or setting the direction of the borehole path, however this phase is somewhat inefficient due to factors including the indirect angular path and the friction or drag of the sliding drill string. Once the desired borehole inclination is established, a rotating operation commences which uses a combination of simultaneously rotating the mud motor/drill bit and the drill string (which continuously rotates the bent housing) and which favorably results in both a higher rate of penetration (ROP) and a substantially linear path.

Drilling in this manner is accomplished by supplying pressurized fluid through the center of the drill string to turn the mud motor and drill bit at the base of the hole while applying sufficient torque resistance at the surface to prevent the drill string from rotating. In the parlance of directional drilling practices, this is usually referred to as "sliding" as the only external portion of the drill string that is rotating is the drill bit. The drill bit is advanced in a manner described above such that the drill string slides without rotating along the existing borehole to advance the drill bit and maintain the action of removing material from the base of the borehole. This comprises the normal manner in which the borehole alignment can be changed with respect to vertical (referred to as the inclination and ranging from zero at vertical up to 90 degrees when horizontal) and a horizontal reference direction, usually true or magnetic north (referred to as azimuth and ranging from zero to 360 degrees with respect to the orientation of the drill string to the reference direction in the horizontal plane).

When the drill string is being rotated while the drill bit is being rotated by the mud motor, the hole is lengthened but there is little tendency to change direction. Called "rotating" in directional drilling parlance, this mode of drilling is used to advance the borehole along an axis that coincides with the axis of the mud motor which in turn roughly coincides with the line that runs through the center of borehole. Drilling in this manner serves to maintain the inclination and azimuth at constant values while the borehole is lengthened, or in more simple terms, tends to drill a straight borehole.

Turning the borehole or drilling in sliding mode requires one to prevent the drill string from rotating while maintaining or controlling the parameter used to advance the drill bit as material is removed from the base of the borehole. As the length of the borehole increases, static frictional resistance to drill string movement along the borehole also increases. This is especially true in the case of wells being drilled horizontally or at a high angle of displacement relative to vertical.

The force required to overcome the static friction resistance is typically supplied by lowering the drill string at the surface to decrease the buoyant weight of the drilling assembly carried by the surface hoisting system and thereby increasing the axial force acting along the borehole axis. The amount of force required to initiate movement of the drill string can be substantial in wells with a significant length of borehole at a high angle of displacement off vertical. Overcoming the static friction to initiate movement can result in significant drill string movement and cause problems in controlling the orientation of the bit and amount of force applied on the cutting structures of the bit. In severe cases the amount of movement of the drill string after overcoming the static friction can cause an overload on the cutting structures of the drill bit which can damage the bit, exceed the torque available to turn the bit or alter the orientation of the cutting structure so that the hole is not being curved in the desired direction.

Methodologies for minimizing the effect of static friction include U.S. Pat. No. 6,997,271 to Nichols et al. which discloses an assembly for permitting rotation slippage between a lower portion of the drill string and an upper tubular of the drill sting to thereby release torsional energy from the drill string and lessening incidences of slip-stick during drilling. In U.S. Pat. No. 5,738,178 to Williams et al, the slip-stick problem during sliding is obviated by continuously rotating the drill string while compensating at the BHA by adjusting the direction and rotational speed of the BHA to either maintain the BHA in a static position for directional drilling despite the rotating drill string, or to rotate with the drill string or independently of the drill string. This requires significant control of the BHA.

Other methodologies for mitigating the effect of static friction is to oscillate the drill string at the surface in a manner that rotates the drill string in one direction for a short distance or time followed by an equal amount of rotation in the opposite direction. The purpose of this method is to keep much of the drill string in motion, however slight, to reduce the amount of static friction to be overcome when attempting to advance the drill string along the borehole.

There are a number of patents issued for this method and they vary mainly in how the movement of the drill string is monitored and controlled. Such methodologies are described in U.S. Pat. No. 6,050,348 to Richardson et al. (Canrig Drilling Technology) U.S. Pat. No. 6,918,453 and U.S. Pat. No. 7,096,979 to Haci (Noble Drilling) and U.S. Pat. No. 7,152,696 to Jones (Comprehensive Power, Inc.). These methods of mitigating the effects of static friction, when sliding, have relied on rocking the quill of a surface swivel assembly of the drill string back and forth to induce movement in much of the drill string to reduce the amount of the static friction that must be overcome to advance the drill string as the bit removed material from the base of the borehole. Though effective, it is believed that this technique still allows the drill string to be stationary at the point of zero rotary speed, which occurs at the end of each period of rotating in one direction. One may deduce that that, every time the rotation is reversed, the static friction to induce rotation must be overcome to start rotary movement in the opposite direction. As this is controlled from surface, one might further deduce that from a stationary position, rotation in any direction will start at the surface and propagate down the borehole to the BHA so as to not affect tool-face orientation. It is believed that the amount of axial force required to overcome static friction varies constantly and that there is only a brief period during each rocking cycle when the entire desired amount of drill string is actually in motion. Axial movement is most likely to occur when the static friction is at it's lowest, which is when the maximum amount of drill string is in motion. In this manner, the drill string will be advanced in small slides at the end of each rocking sequence which is not optimal for drilling.

There is still a need for a solution for effective methods to mitigate the effect of static friction on axially advancing of the drill string when directional drilling.

SUMMARY OF THE INVENTION

Generally the effect of static friction on axially advancing of the drill string when directional drilling, as described above, is avoided by keeping the drill string rotating continuously in one direction in a manner that still allows the borehole direction to be changed in a controlled manner. During steering, the rotary speed of the drill string is varied within a revolution and substantially similarly for each of a plurality of subsequent revolutions. The drill string can be rotated very slowly when oriented at or near the desired orientation to achieve the desired change in direction and then rotated much faster during the balance of each revolution. This serves to cause a bottom hole assembly (BHA) to drill at or near the desired orientation, or an effective tool-face orientation ETFO, for a high percentage of the time it takes for each revolution. This changes the borehole orientation in the desired manner without having to confront the effects of static friction that arise when part or all of the drill string are not being rotated continuously. The position of the BHA relative to the fixed reference direction of the borehole is known. A control system can calculate a desired variable rotational velocity or angular velocity profile such that the rotary speed is varied during each revolution in a manner that the borehole is drilled at about the desired orientation. The rotary speed at any particular point in the rotation of the drill string, relative to the reference direction, can be similar for each revolution. For correcting a trajectory, the velocity profile can be shifted by a corrective angular offset for adjusting the first ETFO to a corrected, second EFTO for steering towards the desired trajectory.

This velocity profile allows the drill bit to preferentially remove material such that the borehole direction is changed in a controlled manner. The duration of drilling in this mode could be as short as one or a small number of rotations followed by a period of conventional rotating drilling, where both the drill string and BHA are rotating, or could be employed continuously to effect a continuous curvature to the borehole. The control system can incorporate an algorithm, used to calculate the desired rotary speed of the drill string, which uses the relative position of the rotating drill string assembly to the reference direction, the instantaneous rotary speed of the drill string and the instantaneous applied torque to the drill string.

In one broad aspect of the invention, a method of steering drilling along a desired trajectory for at least a portion of a borehole in a subterranean formation is provided comprising: rotating a drill string from surface, the drill string extending downhole along the borehole; supporting a drill bit at a distal end of the drill string, the drill bit being angularly deviated from an axis of the distal end of the drill string; rotating the drill bit relative to the drill string for drilling the borehole; and continuously rotating the drill string in one direction and varying the angular velocity of the rotation of the drill string within each rotation, for each of a plurality of revolutions, between at least a fast and a slow angular velocity, and varying the angular velocity of the rotation of the drill string substantially similarly for each of a plurality of revolutions wherein the drilling of the borehole is steered along the desired trajectory.

DETAILED DESCRIPTION OF THE PREFERRED EMBODIMENTS

Figure 1A:
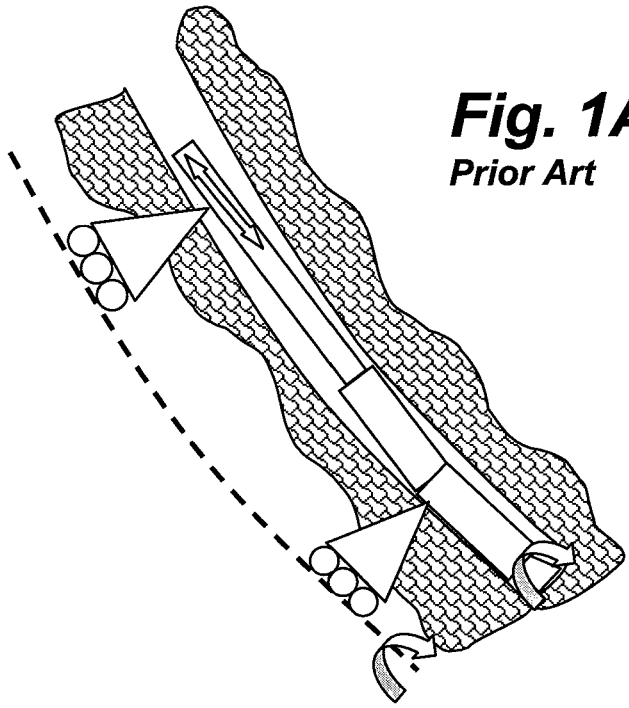
Fig. 1A Prior Art
FIG. 1A is a schematic cross-section of the "A" portion of the path of FIG. 1 illustrating directional drilling while sliding.
Figure 1:
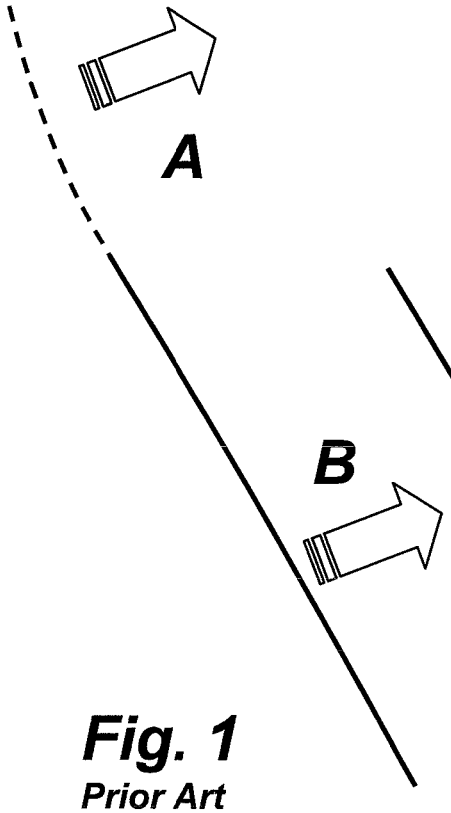
Fig. 1 Prior Art
FIG. 1 is a schematic of the drilled path of a borehole during the prior art methods of sliding and rotating.
Figure 1B:
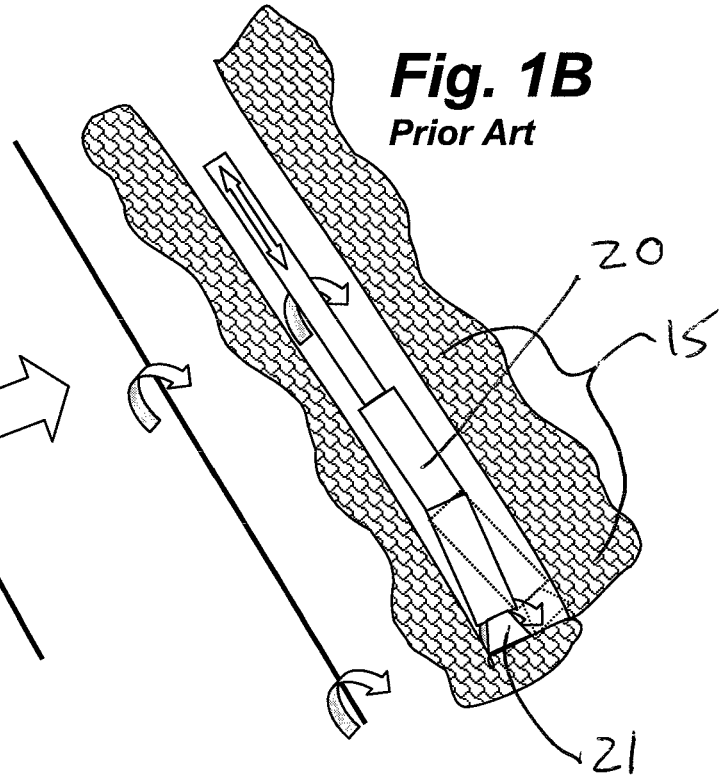
Fig. 1B Prior Art
FIG. 1B is a schematic cross-section of the "B" portion of the path of FIG. 1 illustrating straight drilling while rotating.

With reference to FIGS. 1,1A and 1B, a schematic of two drilling modes of the prior art illustrate, as first shown in FIGS. 1,1A, a borehole being drilled in which the drill string is non-rotating and is "sliding" while a drilling assembly, including a bent housing having a motor and a drill bit, drills the borehole along a curved path as determined by the bent housing. As shown in FIGS. 1,1B, the drill string can also be rotated continuously, continuously reorienting the bent housing for drilling a straight path having a slightly larger borehole. The desired trajectory or path of the resulting borehole is achieved using a combination of the "sliding" and rotating drilling. An operator periodically or continuously monitors the tool-face orientation such as through periodic surveys while sliding using measurement while drilling (MWD) tools. While sliding, a portion of the drilling assembly slides without rotating and MWD can be used. Conventionally, for adjustment of the borehole path, the operator identifies a deviation from the desired trajectory and rotates the drill string through an angular offset or "bumps" the drill string to achieve an incremented tool-face orientation. Thereafter, one can then drill for a subsequent interval using sliding drilling in the new drilling direction. More recent technologies oscillate the drill string from surface to lessen frictional effects while, adjacent a downhole end of the drill, the drilling assembly continues to slide to avoid affecting the tool-face orientation. However wind-up and other borehole parameters limit the effectiveness of these methodologies. High frictional interaction between the drill string and the borehole can result in low penetration rates and difficulty in ascertaining the tool-face orientation.

As discussed in embodiments of the present invention, such difficulties are obviated by maintaining substantially continuous motion of the drill string, even during steering for changing borehole direction.

Generally, apparatus and a methodology of operation is provided for minimizing friction during directional drilling. A drilling assembly including a bent housing with a motor and a drill bit are located at a downhole end of the drilling string for rotating the drill bit relative to the drill string. Rotation can be maintained throughout the otherwise conventional rotary drilling mode, in which the drill string is continuously rotated for forming substantially linear boreholes. Contrary to the prior art approach of sliding however, rotation in one direction is also maintained during steering in which the angular velocity of the drill string rotation is varied within a rotation and similarly applied to each of a plurality of rotations for effecting an arcuate path to the borehole.

Uni-directional rotation of the drill string is maintained throughout both a directional mode or steering and a straight drilling mode.

Figure 2:
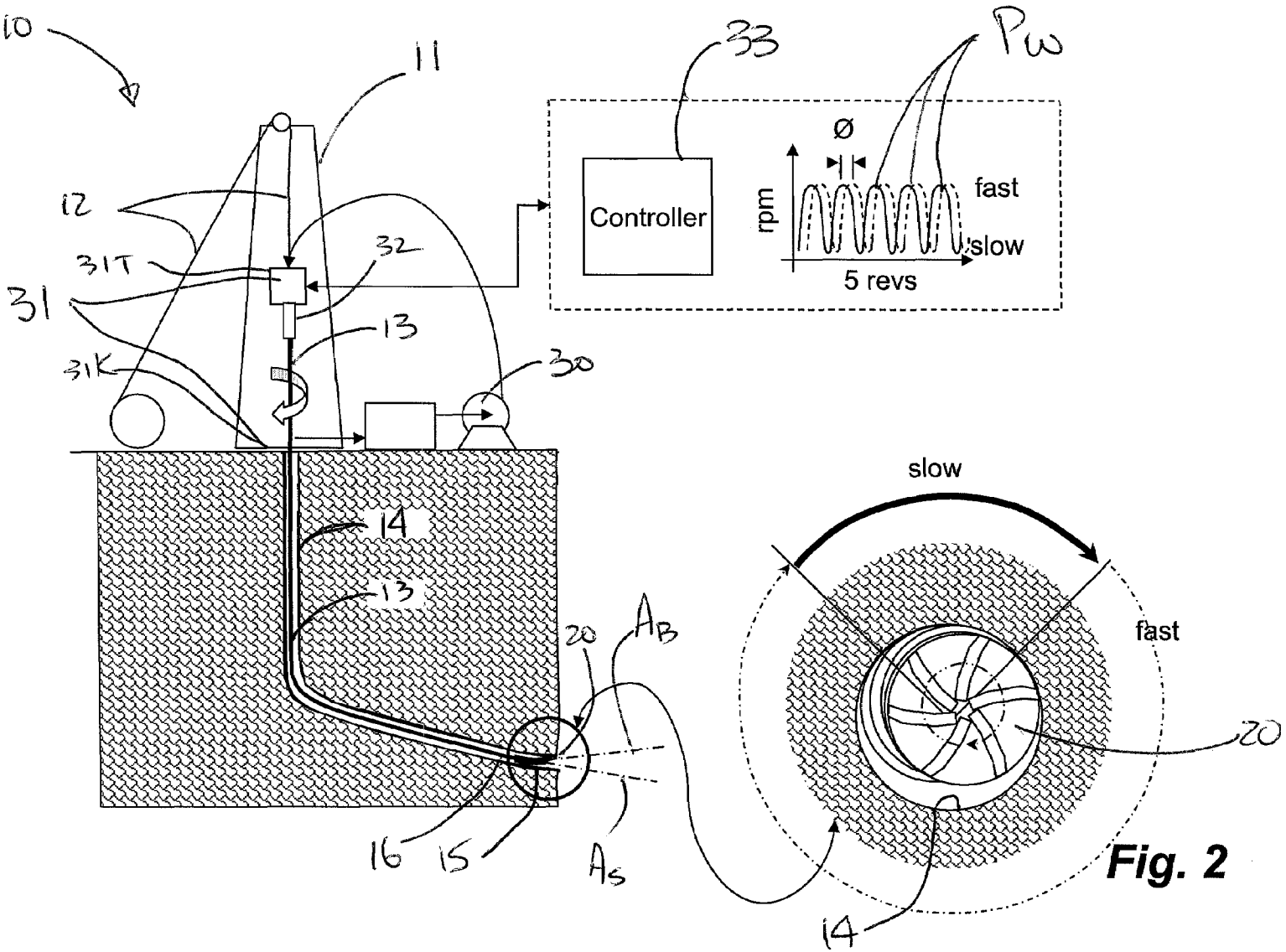
FIG. 2 is a schematic representation of a rig drilling a subterranean formation, controlled using an embodiment of the present invention and illustrating an end view of a cross-section of the bottom of the wellbore demonstrating variable angular rotation applied similarly for each of a plurality of revolutions for steering along a desired trajectory.

With reference to FIG. 2, a drilling rig 10 supports a derrick 11 and lifting gear, such as a drawworks 12, for manipulating a drill string 13 into and out of a borehole 14. The drill string is formed of a plurality of lengths of drill pipe and a bottom hole assembly (BHA) 15 supported at a downhole or distal end 16 of the drill string 13. Referring also to prior art FIG. 1A, the BHA 15 comprises a drill bit 20 and a bent sub or downhole bent housing 21, including motor, for driving the drill bit. Typical drill bit rotation speeds are between 60 and 400 rpm depending on the type of drill bit. The bent housing 21 permits a drill bit axis $A_B$ to be deviated from an axis $A_S$ of the distal end of the drill string 13. The tool-face axis $A_B$ of the drill bit is at a non-zero angle to axis $A_S$ the drill string. Typically the angle is in the range of 1 to 3 degrees.

Mud pumps 30 deliver drilling fluids to the drill string 13 to rotate the downhole motor and drive the drill bit 20. The rig 10 includes a rotary drive 31 for rotating the drill string 13 such as a rotary table and kelly 31K or a top drive 31T. The rotary drive 31 typically rotates a drill string at a speed of about 20 to 60 rpm.

In either embodiment and most recognizable in a embodiment utilizing a top drive 31T, a quill 32 is adapted for rotatable and drivable connection to the drill string and one or more motors of the top drive for rotating the quill 32.

The rotary drive 31 is controlled by a controller 33 for varying the rotational speed of the drill string 13. During steering, the angular velocity ω or instantaneous revolutions per minute (rpm) of the drill string rotation is varied throughout each rotation, the varied angular velocity having a velocity profile Pω, for orienting the drill bit 20 substantially in one general direction for a majority of the duration of that rotation.

Figures 3A, 3B, 3C:
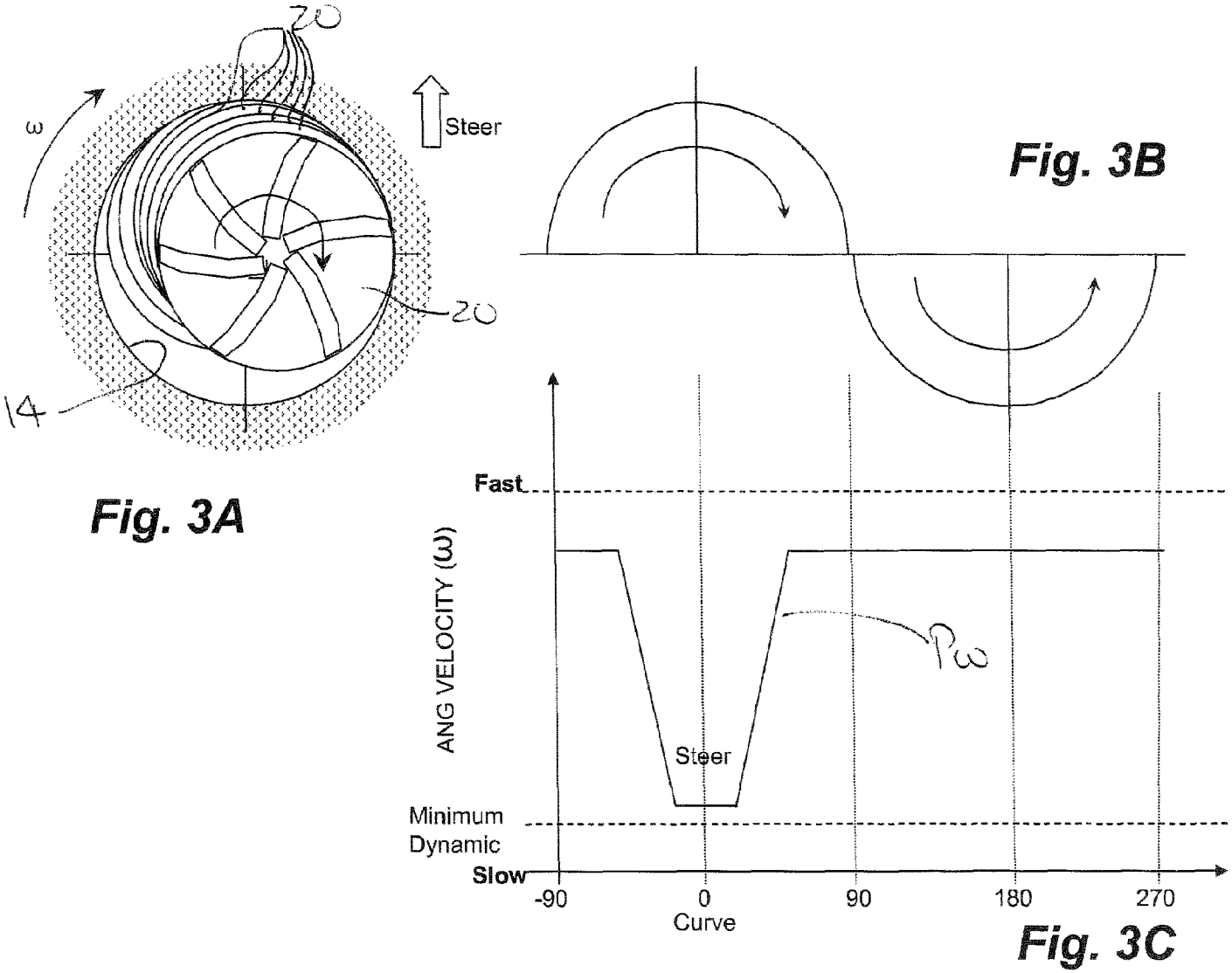
FIG. 3A is a schematic view of a section of a drilled borehole according to one embodiment of the invention fancifully illustrating equi-periodic snapshots of the location of the drill bit's tool face as the drill string rotates the BHA with slow rotation adjacent the top of the borehole such as to steer the borehole upwardly.
FIG. 3B is a roll-out representation of the borehole of FIG. 3A over one full rotation of the drill string, the bottom 180 degrees being mirrored for illustration only.
FIG. 3C is a graph corresponding to the borehole roll-out of FIG. 3B, illustrating the variable rotational speed or angular velocity of the drill string relative to the direction of the desired curve during steering.

With reference to FIG. 2 and also to FIGS. 3A to 3C, the drill bit 20 as shown in FIG. 3A rotates at an effective rpm to drill the borehole. The drill string rotates at a variable angular velocity ω. As the drill bit is swept through one revolution (FIG. 3B), the angular velocity is varied (FIG. 3C) so that rotational rpm is slow while the bent housing is oriented substantially towards a target direction to steer the drilling (shown as upward for illustrative purposes) and the rotational rpm is fast as the bent housing is oriented away from the target direction to minimize drilling in directions other than the target direction. FIG. 3C illustrates one exemplar variable angular velocity profile Pω.

Repeating a substantially similar velocity profile Pω for each of a plurality of revolutions of the drill string 13 steers the borehole towards the target trajectory, usually forming a curved borehole. In other formations, the steering is applied to counter formation influences so as to maintain a straight borehole where conventional rotary drilling would be influenced to produce a curved borehole. Simply, the angular velocity of the drill string is varied within each revolution between at least a fast and a slow rotation, and varying the angular velocity of the rotation of the drill string substantially similarly for each of a plurality of revolutions wherein the drilling of the borehole is steered along the desired trajectory.

Even though the conventional tool-face is constantly varying, albeit at a variable angular velocity, there is an effective tool-face orientation or ETFO which results in steering. Where the actual trajectory has deviated from the desired trajectory, the EFTO is adjusted so as to re-establish the desired trajectory. The EFTO is adjusted by a corrective angular offset Φ.

Typically, once the desired trajectory or path is reached, rotary drilling can be resumed for drilling substantially along a straight path portion of the desired trajectory. Simply, during the period of the revolution in which the tool-face of the drill bit 20 is oriented in the desired direction, the rotation of the drill sting is relatively slow, and conversely, when the tool-face is oriented away from the desired direction, the rotation of the drill string is fast, being increased to minimize interference with the build angle. Continuous uni-directional rotation, whether constant or varying, minimizes the effects of friction while drilling the borehole, avoiding efficiency losses associated with prior art reciprocating methodologies. It may be desirable to establish a minimum angular velocity to ensure the drill string remains dynamic.

Rotary drives capable of such variable angular rotation can include one or more motors (not detailed) such as one or more hydraulic motors. More than one motor enables shifting torque and speed capabilities depending on the drilling conditions. Such hydraulic motors can be powered by a hydraulic pump controlled by a variable frequency drive (VFD) and AC motor. The VFD is micro-processor or computer-controlled for precisely outputting a speed setpoint for drill string rpm. The output of the controller 33 can be based on variables such as drilling parameters, measurement while drilling (MWD) surveys, and the drill string rotational objectives. MWD sensors are employed for determining the tool-face orientation.

To reduce significant friction between the drill string and the borehole the drill string is rotated continuously. When the rotary drive rotates the drill string, the drill string winds up along its length and eventually the BHA starts to rotate. The wind-up can number multiples of revolutions. In rotating drilling mode, the tool-face is usually not closely monitored relative to the rotary drive. However, in directional mode, one does monitor the correspondence between the tool-face orientation and the rotary drive. The rotary drive 31 has a reference point associated with the drill string 13 so that the effective tool-face orientation can be matched to the rotary drive. For example, the top drive quill 32 can be fit with a reference sensor (not detailed). Reference sensors could include one or more of magnetic or capacitance pickups, encoders or mechanical switches.

Wind-up is related to a variety of inter-related drilling parameters including the length of the drill string, borehole trajectory, torque imparted to the drill string and weight-on-bit (WOB). Where all parameters are maintained as constants, the wind-up remains consistent. Further, skilled persons can apply algorithms which predict wind-up under varying drilling parameters such as the change in the length of the drill string as pipe is added and operational parameters of torque and WOB. Such predictions can be empirically derived, theoretically determined or a combination of both. One can drill a first incremental portion or interval of the borehole and compare the actual trajectory to the desired trajectory of the incremental portion for establishing a corrective angular offset, if any. One can adjust the effective tool-face orientation by shifting the phase of the velocity profile by the angular offset. If longer incremental portions of the borehole are to be drilled using steering, then it is desirable to compensate on the fly using predictive techniques to apply an incremental angular offset related to the above parameters with the lengthening borehole. One can estimate an incremental angular offset which corresponds to each incremental change in borehole length, formation or trajectory. With such predictive techniques, one can estimate wind-up and progressive angular offsets and apply the incremental angular offsets while steering rather than waiting for the termination of a fixed interval. Simply, one could steer along a first incremental portion of the borehole, adjust the velocity profile as necessary and then steer a longer incremental portion of the borehole using the corrected effective tool-face orientation and adjusting the velocity profile as other parameters change.

Figure 4:
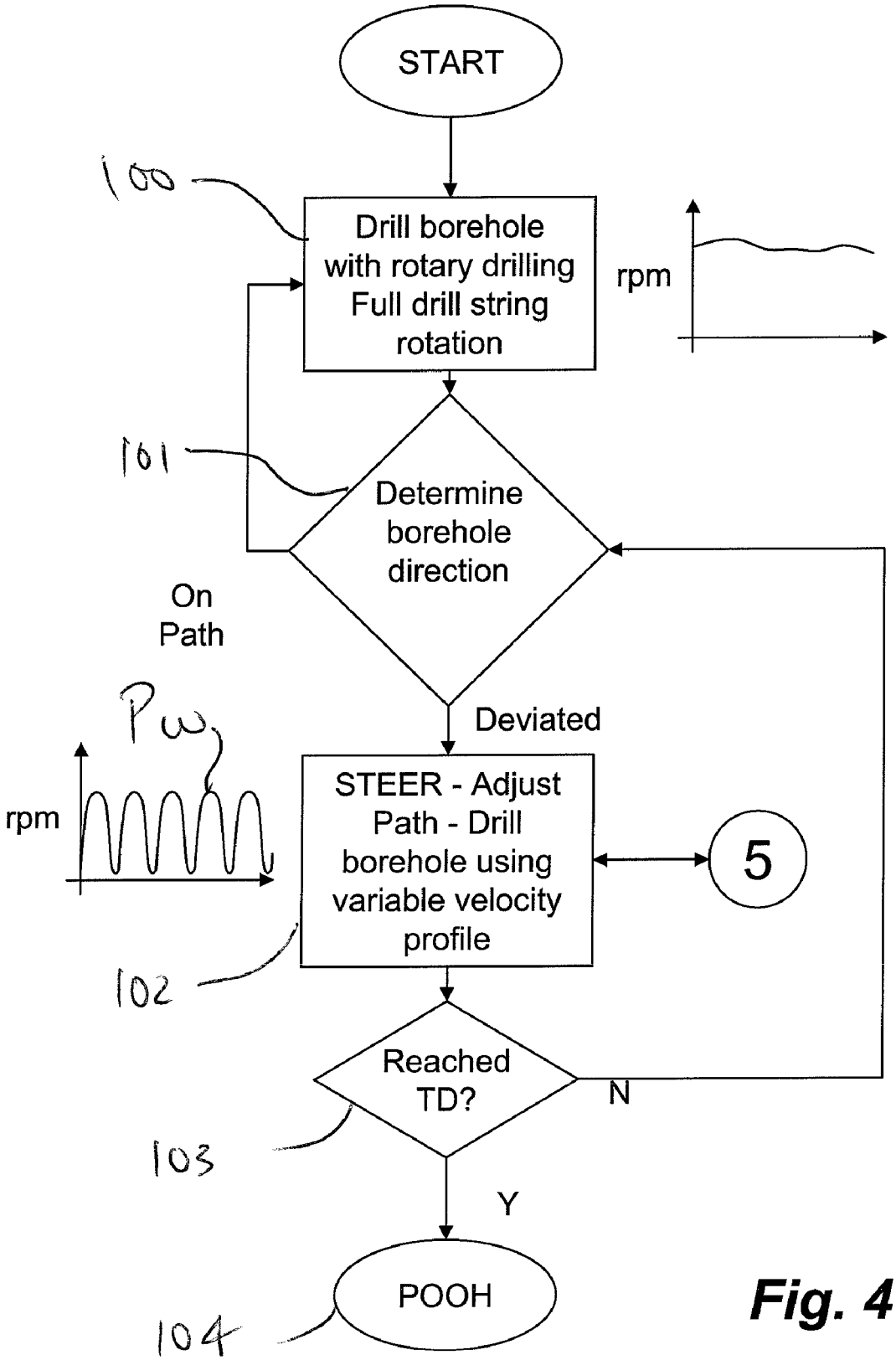
FIG. 4 is a flow chart describing one embodiment of the methodology of the invention for drilling a borehole using continuous rotation while steering and conventional rotating drilling for drilling a straight borehole.

As shown in FIG. 4 in one embodiment, with the drill bit being driven relative to the drill string, one can drill a borehole along a desired trajectory, such as a straight trajectory, by rotary drilling a portion of the borehole at 100. Periodically, the borehole direction is determined at 101 and if the borehole is on path along the desired trajectory, then rotary drilling is continued. If the drilling direction has deviated, then steering is commenced using a velocity profile Pω to adjust the path at 102 by applying the velocity profile to the continuous rotation of the drill string. One compares the actual trajectory to the desired trajectory, determines if the borehole is back on path and if so the steering or full rotary drilling continues using a variety of steering and rotary drilling to total depth TD at 103 and the drill string and BHA are pulled out of hole (POOH) 104.

Figure 5:
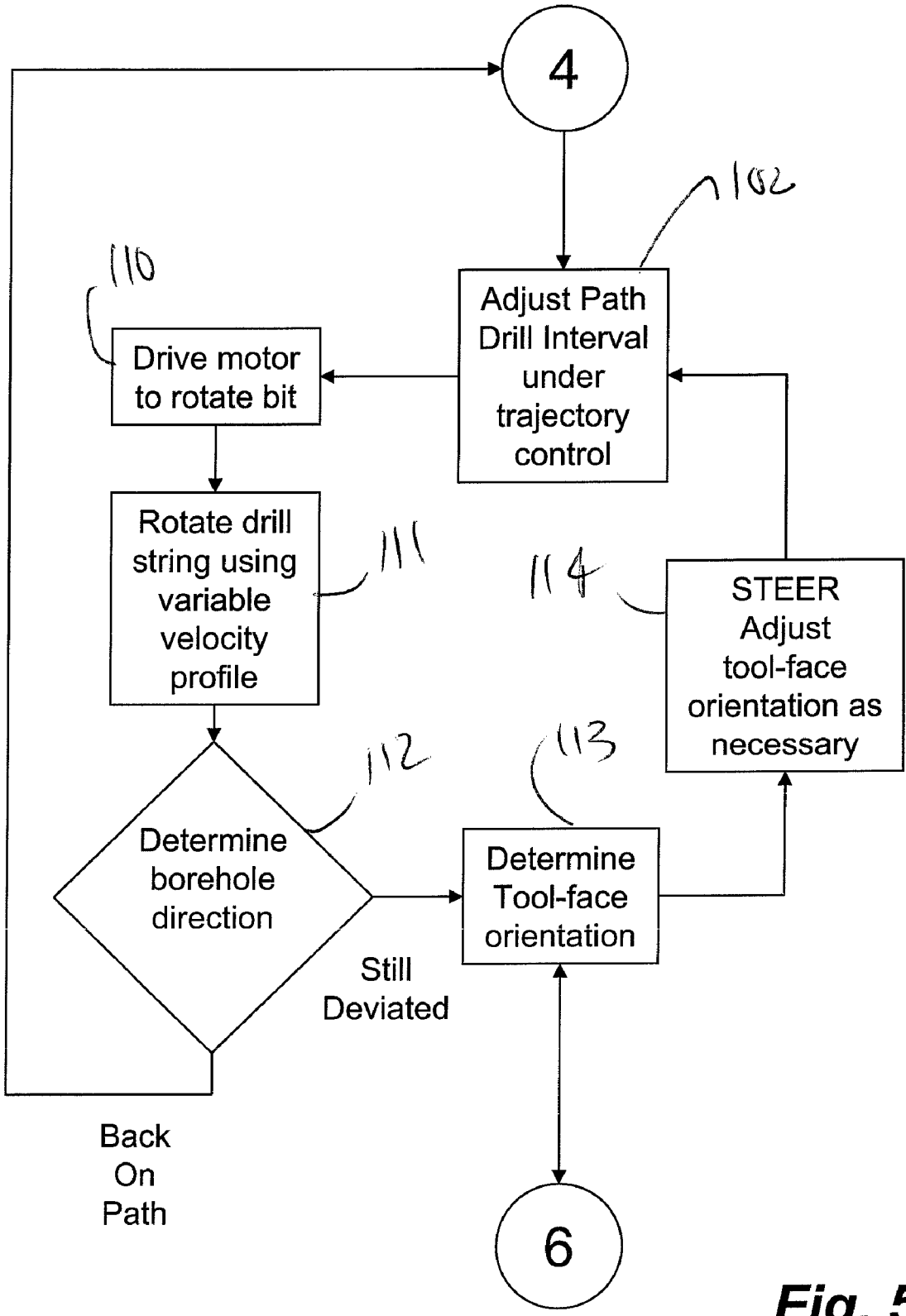
FIG. 5 is a flow chart describing one embodiment of the steering aspect introduced in FIG. 4.

As shown in the sub-flow chart of FIG. 5, steering at 102 comprises rotating the drilling bit at 110 and rotating drill string using the variable velocity profile Pω at 111. The borehole direction is checked at 112 and if still deviated, the drill bit tool-face orientation is checked at 113 and adjusted as necessary at 114.

Figure 6:
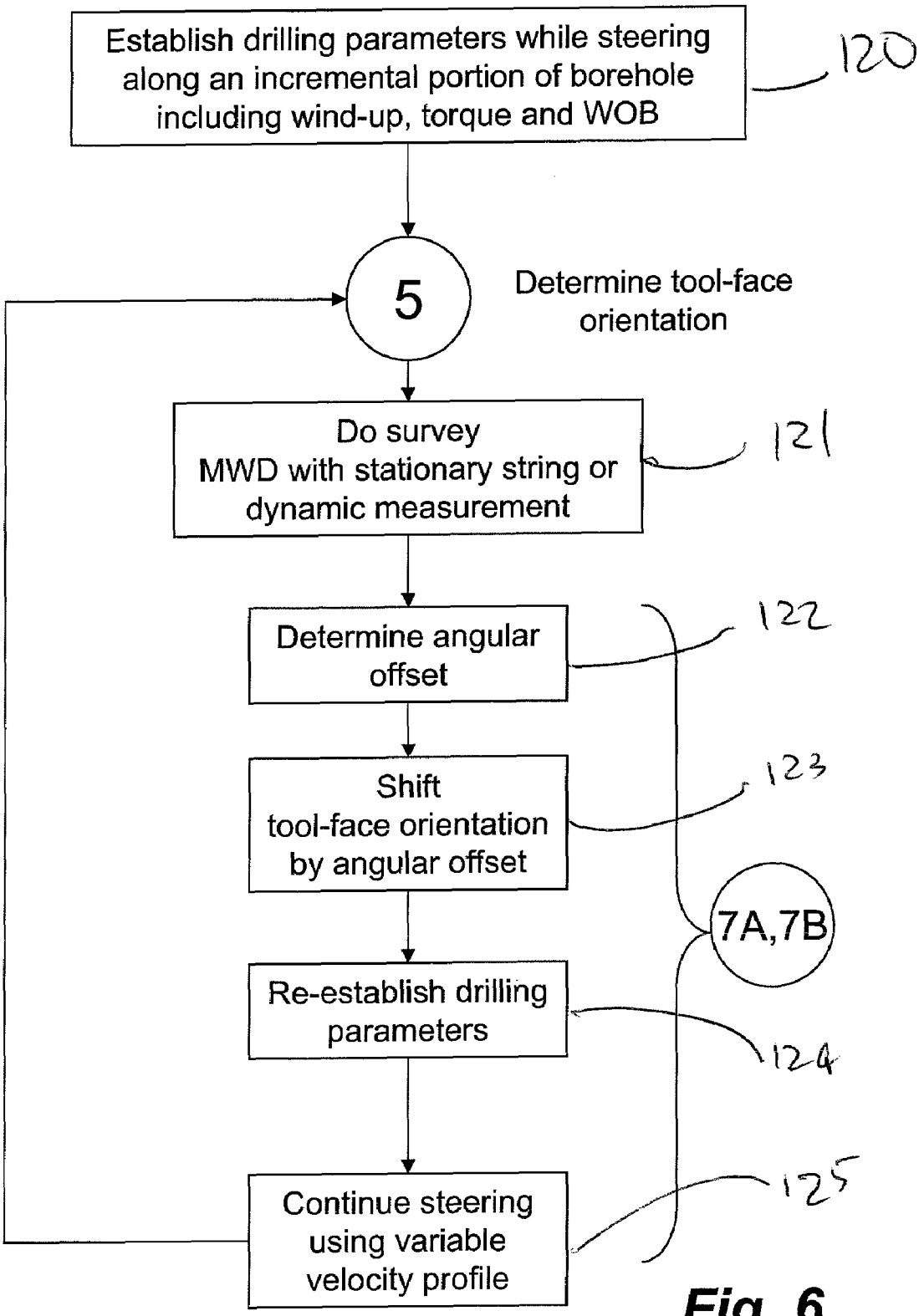
FIG. 6 is a flow chart describing one embodiment of a methodology for establishing the angular offset during steering as introduced in FIG. 5.

With reference to the sub-flow chart of FIG. 6, one method to determine tool-face orientation is to first have established steady-state drilling parameters at 120 which affect wind-up while drilling an incremental portion of the borehole. One performs a survey with a measurement while drilling (MWD) at 121, either using dynamic measurement while rotating, or stopping rotation so as to establish inclination and azimuth for determining the tool-face orientation. If the borehole is going in the wrong direction—by an angular offset ϕ determined at 122—then a first effective tool-face orientation (ETFO), whatever it has been, needs to be adjusted to a new, second ETFO so as to re-establish the desired trajectory. The effective tool-face orientation (ETFO) can be shifted at 123 and by re-establishing the steady-state drilling parameters at 124, the borehole will be steered in the desired direction. One can continue to steer at 125 using the velocity profile Pω and drill the borehole.

Figure 7B:
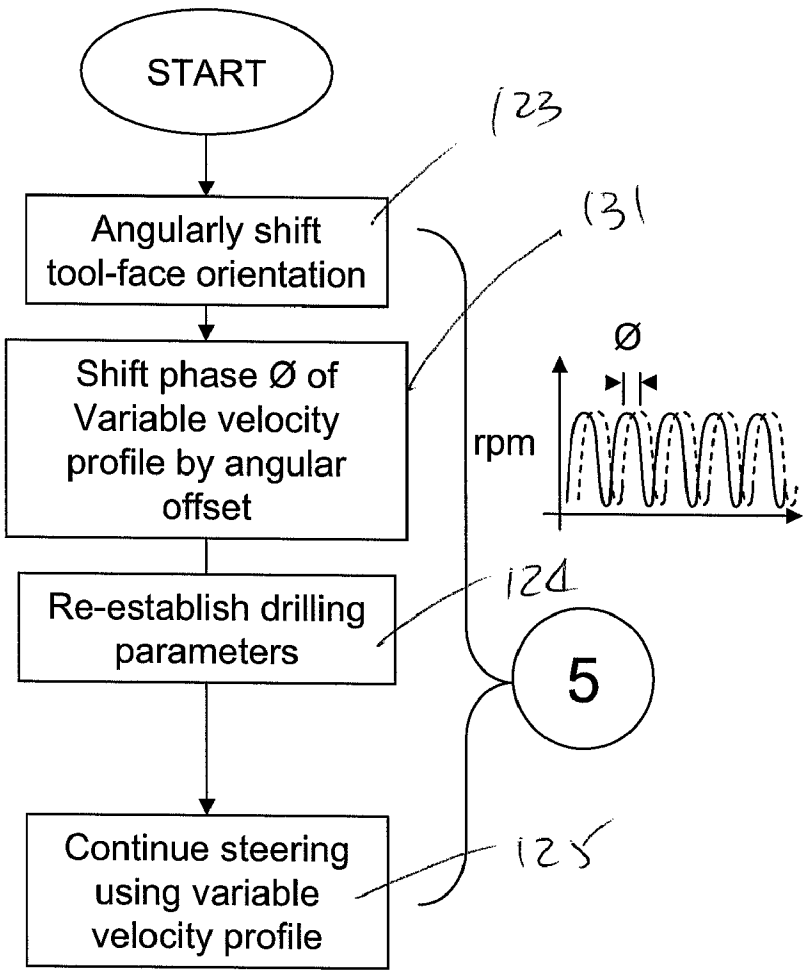
FIGS. 7A and 7B are mechanical and control methodologies respectively for shifting the tool-face orientation as introduced in FIG. 6.
Figure 7A:
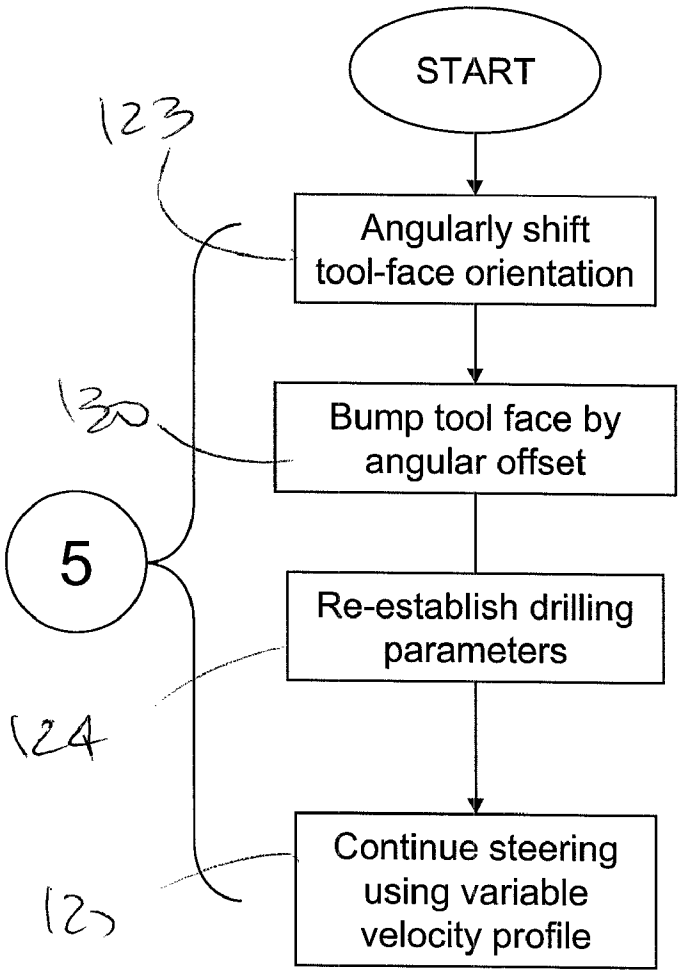

Two methods for adjusting the effective tool-face orientation at 123 include shifting mechanically (FIG. 7A) or through the controller (FIG. 7B). As shown in FIG. 7A, the drill string can be bumped at 130 using a torque spike or as shown in FIG. 7B, the controller can implement a phase shift at 131, by the corrective angular offset Φ, of the velocity profile Pω, wherein the slow or steering portion of the rotation is angularly adjusted by the angular offset Φ which is substantially equal to the phase shift Φ.

In both cases, after bumping the drill string or shifting the phase Φ of the velocity profile Pω, one re-establishes the drilling parameters and continues steering using continuous, unidirectional variable rotation of the drill string.

Using embodiments of the invention, by implementing substantially continuous rotation of the drill string, one avoids static friction as the entire drill string is kept in continuous motion in one direction. Continuous rotation need not be constant rotation. The rotary drive 31 is slowed to a very low rotary speed when the tool-face of the drill bit 13 is pointing at or near the desired orientation. The speed of the rotary drive 31 can then be increased to a much higher speed during the rest of each rotation. Accordingly, the drill bit tool-face orientation will be drilling within a specified arc that includes the desired orientation for much of the time of each rotation. The percentage of time of each rotation where the tool-face is oriented within a specified arc, that includes the preferred orientation, depends on the physical constraints of the mechanical system used to drive the quill 32 as well as the material properties of all the drill string components.

For example, notwithstanding the mechanical limitations described, it is possible to have the tool-face oriented within about 30 degrees of the desired direction for over about 80% of the time of each rotation by simply rotating at 3 degrees per second (0.5 rpm) within a 60 degree arc centered about the desired direction. Further, during the balance of each rotation, the quill 32 can be accelerated up to about 120 degrees per second (20 rpm), held briefly at that speed, and then decelerated back to the slow speed of 3 degrees per second with acceleration rates of ±60 degrees per second per second between the periods of constant rotational speed. The velocity profile can be determined for a variety of surface equipment, drill string, BHA and borehole conditions.

Figure 8A:
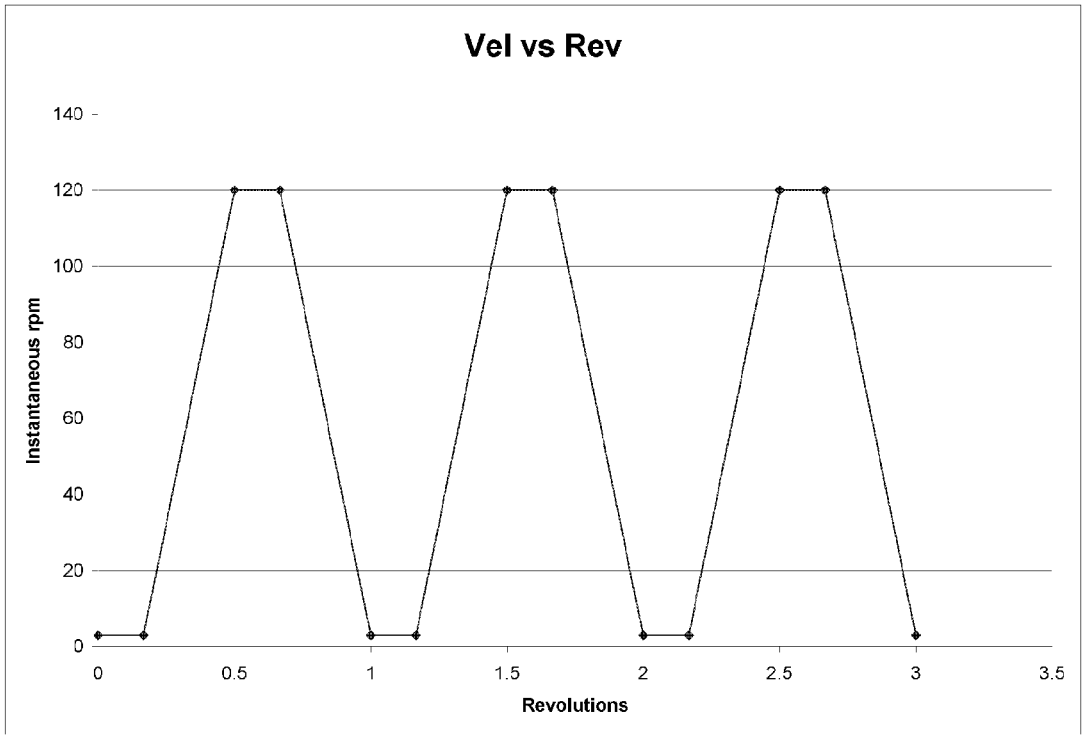
FIGS. 8A and 8B are graphs of the similar instantaneous rotational velocity of a drill string for each of three revolutions and the instantaneous rotational velocity versus time.
Figure 8B:
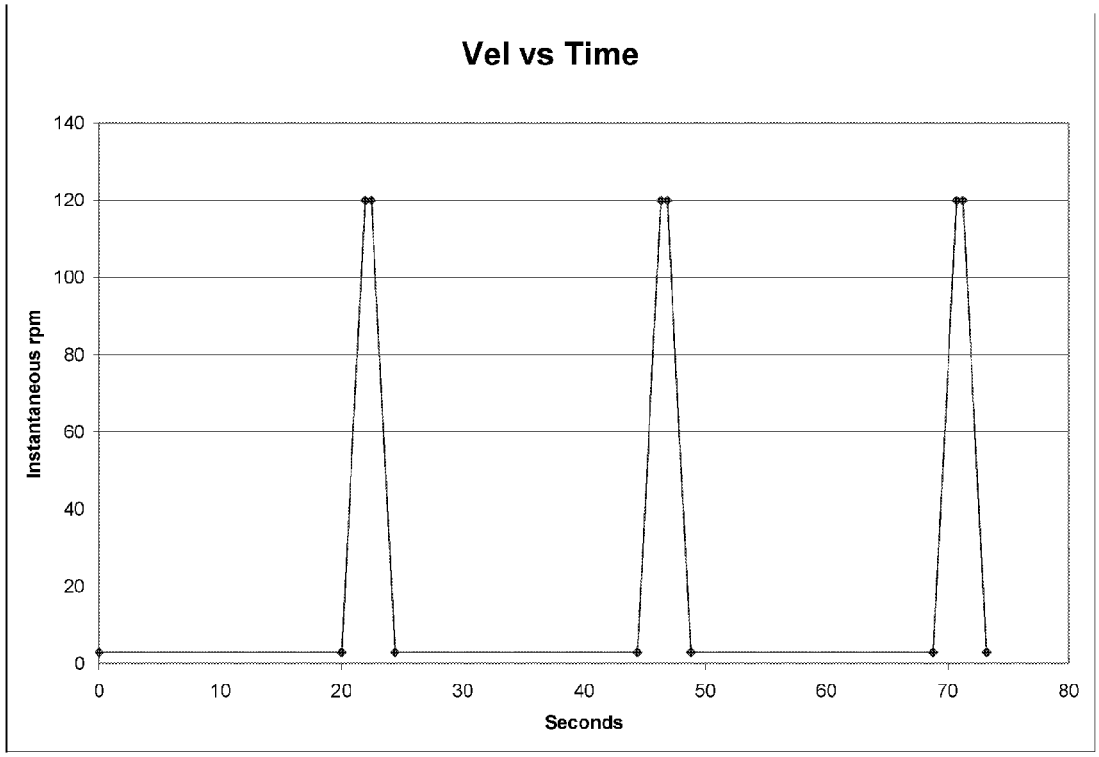

The angular velocity of the quill 32 and resulting velocity of the drill string 13 may be varied in a variety of embodiments. One included method is to control the quill velocity in a manner similar to that described above so that the velocity profile Pω can be described as a function of the phase angle of the quill relative to a fixed reference direction. The relationship between the angular velocity ω and phase angle can be described in many ways, including two arcs of fast and slow speed with linear acceleration or deceleration between the two speeds; a constantly increasing or decreasing velocity profile Pω, commonly referred to as a "sawtooth" profile, and a sinusoidal or other type of periodic variation in the velocity ω such as may be required or preferred for certain types of drive systems. FIGS. 8A and 8B demonstrate a suitable velocity profile Pω. As shown in FIG. 8A, for three illustrated revolutions of the drill string, the profile is substantially the same or similar. As shown in FIG. 8B, the time that the drilling is oriented in the desired direction is maximized with a fast reset to repeat with a similar velocity profile for the subsequent revolution.

Another method is to directly control the torque at the quill 32 as a function of phase angle. In this embodiment the applied torque can be varied as a function of quill direction. The relationship between the applied torque and phase angle may be similarly described as above. The determination of torque may be direct, such as by recording pressures in a hydraulic system, or by calculation with an electronic control system such as is found in most variable frequency drives.

Another method is to use a derivative of the primary parameters of rotary speed and rotary torque; calculating applied power or stored energy of the mechanical system using measured speed and torque. The method of varying the chosen parameter as described above may be by: calculation such as would be found on an electronic control system using software, electronic feedback control where a position input would create an output setpoint for a control parameter; or mechanical feedback control where a cam type actuator on the quill can be directly used to control a drive parameter such as speed or torque.

The method chosen to vary the quill velocity will depend on the borehole conditions, type of drill bit 20, drill string 13 and surface equipment or rig 10. There will be several embodiments that prove effective because of the variation in the above parameters. However all embodiments implement a varying of the rotary speed of the drill string in the same or similar manner during each revolution so as to be able to directionally drill a borehole.

One example of how this may be utilized would be to perform the following steps. With appropriate sensors and drive equipment installed, and with the drill string 13 hanging such that the drill bit 20 is being rotated by the downhole motor a short distance from a bottom of the borehole 14, start rotating the quill 32 using the controller 33 to conform to a predetermined velocity profile Pω relative to a fixed reference direction of the quill 32. Advance the drill bit 13 in a controlled manner until the indicated weight of the hanging assembly (hookload) indicates the desired axial force (WOB) is being applied to the drill bit 20 at which point the drawworks 12 control is set to maintain the suspended weight at that value by lowering the hoisting assembly as drilled material is removed from the base of the borehole 14. After drilling a set incremental distance using the above described velocity profile Pω and maintaining steady-state drilling parameters such as hookload and mud pump rpm at constant values, perform a standard wellbore deviation survey to determine the change in azimuth and inclination of the well bore and thereby infer what a first effective tool-face orientation (ETFO) was during the most recent drilling interval. The first EFTO is then compared to second EFTO calculated to affect the desired borehole trajectory and a corrective angular offset or displacement is calculated therebetween so that when that angular offset is applied to the reference direction of the quill 32, subsequent drilling of the borehole will be within allowable tolerance limits of the desired trajectory. Drilling continues using the same drilling parameters as long as the steering is required. Inserting tubulars in the drill string as the hole is advanced can be compensated by recalculation of the desired hookload and reference direction to account for the additional length and weight of the drill string.

While various surface equipment can be utilized, examples of suitable rotary drive 31 and controller 33 for implementing embodiments of the invention can be specified as follows. The rotary drive is typically a "top drive", being essentially a torsionally restrained, power swivel assembly which delivers rotary torque to effect drill string rotation, or a conventional rotary table drive, typical of oilfield drilling rigs. Both drive types can be driven by electric or hydraulic motors.

When the top drive or rotary table are directly driven by an electric motor, it is a variable speed motor. This is accomplished by using a DC traction motor controlled by an SCR control system or an AC traction motor controlled by a Variable Frequency Drive (VFD).

When the top drive or rotary table are driven by a hydraulic motor, it is in turn driven by a hydraulic pump which may itself be driven electrically or mechanically. When driven electrically, a fixed displacement pump may be driven at variable speed or a variable displacement pump may be driven at a fixed speed of a standard electric motor. When driven mechanically, the pump is a variable displacement type.

Each of these systems can be controlled using an independent electronic controller (such as a PLC) or, especially in the case of AC motor/VFD combinations, by embedded control algorithms within the drive system itself.

One form of rotary drive is a top drive system comprising a variable speed drive (VSD) technology over a hydraulic top drive. Top drive quill speed, quill torque and the direction of quill rotation is controlled by driving a fixed displacement bi-directional hydraulic pump with an inverter-duty AC motor. This in turn drives a fixed displacement, bi-directional hydraulic, hollow shaft motor which directly drives the top drive quill.

The rig is enabled for variable drill string rotation, according to the present invention, for steering while maintaining continuous drill string rotation. The controller implements the velocity profile Pω for each revolution of the drill string for effecting steering direction control. As tool-face orientation (angular position) is a known variable (measured, for instance, with MWD technology) and the top drive quill position can be measured at the surface, the unknown "wind-up" of the drill string can be determined and used to predict the position of the tool-face given a specified angular speed bias of the quill. The velocity profile Pω can be shifted by the controller as necessary to adjust the tool-face.

While the invention has been shown and described with reference to specific preferred embodiments, it should be understood by those skilled in the art that various changes in form and detail can be made therein without departing from the spirit and scope of the invention as defined by the following claims.

The embodiments of the invention for which an exclusive property or privilege is claimed are defined as follows:

1. A method of drilling along a desired trajectory for at least a portion of a borehole in a subterranean formation comprising:

establishing an angular reference point of a drill string at the surface, the drill string extending downhole along the borehole;

rotating the drill string from the surface;

supporting a drill bit at a distal end of the drill string, the drill bit being angularly deviated from an axis of the distal end of the drill string;

rotating the drill bit relative to the drill string for drilling the borehole; and continuously rotating the drill string in one direction by varying the angular velocity of the rotation of the drill string within each revolution between at least a fast and a slow angular velocity, the varying of the angular velocity having a velocity profile relative to the angular reference point, and applying the velocity relative to the angular reference point substantially similarly for each of a plurality of revolutions wherein the drilling of the borehole is steered along the desired trajectory.

2. The method of claim 1 wherein the varying of the angular velocity of the rotation of the drill string within a revolution has a velocity profile, the method further comprising:

comparing an actual trajectory of the borehole to the desired trajectory for determining a corrective angular offset therebetween; and shifting the velocity profile by the corrective angular offset.

3. The method of claim 2 wherein the drill bit has an effective tool-face orientation which is angularly deviated from the axis of the distal end of the drill string, the method further comprising adjusting the orientation of the effective tool-face orientation by shifting the velocity profile by the corrective angular offset.

4. The method of claim 1 wherein the varying of the angular velocity of the rotation of the drill string within a revolution has a velocity profile, the method further comprising:

establishing an actual trajectory of the borehole;

determining an effective tool-face orientation for re-establishing the desired trajectory and having a corrective angular offset from the desired trajectory; and shifting the velocity profile by the corrective angular offset.

5. The method of claim 1 wherein further comprising:

comparing an actual trajectory of the borehole with a desired trajectory for determining an angular offset therebetween;

shifting the velocity profile, relative to the angular reference point, by the angular offset.

6. The method of claim 1 wherein during drilling of the borehole the drill string and the borehole incrementally increases in length, further comprising:

estimating an incremental angular offset for each incremental increase in length; and for each incremental increase in length, shifting the velocity profile, relative to the angular reference point, by the estimated incremental angular offset.

7. The method of claim 1 further comprising:

drilling an incremental portion of the borehole;

comparing an actual trajectory of the incremental portion with a desired trajectory for determining a corrective angular offset therebetween; and shifting the velocity profile by the angular offset; and applying the shifted velocity profile to the drilling string at surface.

8. The method of claim 7 further comprising:

establishing steady-state drilling parameters while drilling the incremental portion; and maintaining the steady-state drilling parameters while applying the shifted velocity profile.

9. The method of claim 7 wherein comprising temporarily slowing the rotation of the drill string to a stop for determining the actual trajectory of the incremental portion.

10. The method of claim 7 further comprising:

estimating incremental changes to the steady-state drilling parameters as the borehole is drilled;

estimating an incremental angular offset due to the estimated incremental changes; and further shifting the velocity profile by the incremental angular offset.

11. The method of claim 1 further comprising:

drilling an interval portion of the borehole;

comparing an actual trajectory of the interval portion with a desired trajectory for determining an angular offset therebetween; and shifting the velocity profile by the angular offset;

applying the shifted velocity profile to the drilling string at surface;

increasing the length of the interval portion of the borehole to be drilled; and repeating the drilling of the interval portion of the borehole.

12. Apparatus for drilling along a desired trajectory for at least a portion of a borehole in a subterranean formation comprising:

a drill string extending from the surface and downhole along the borehole;

a bottom hole assembly supported at a downhole end of the drill string comprising a motor and a drill bit, the drill bit being angularly deviated from an axis of the drill string and rotatable by the motor relative to the drill string for drilling the borehole;

a rotary drive at surface for continuously rotating the drill string in one direction, the rotary drive comprising at least a variable speed motor; and a controller coupled to a variable speed drive which in turn is coupled to the rotary drive for varying the angular velocity of the rotation of the drill string within each revolution between at least a fast and a slow rotation, and varying the angular velocity of the rotation of the drill string substantially similarly for each of a plurality of revolutions wherein the drilling of the borehole is steered along the desired trajectory.

13. The apparatus of claim 12 wherein the controller is mechanically coupled to the rotary drive.

14. The apparatus of claim 12 wherein the controller and the variable speed drive are one and the same.

15. The apparatus of claim 12 wherein:

the variable speed motor is at least one hydraulic motor for rotatably driving the drill string, and the apparatus further comprises a hydraulic pump hydraulically coupled to the at least one hydraulic motor.

16. The apparatus of claim 15 wherein the hydraulic pump is a fixed displacement hydraulic pump driven by a variable speed AC electric motor.

17. The apparatus of claim 15 wherein the hydraulic pump is a variable displacement pump.

* * * * *